US006497121B1

(12) United States Patent
Walsh et al.

(10) Patent No.: US 6,497,121 B1
(45) Date of Patent: Dec. 24, 2002

(54) AIR-CIRCULATION ENHANCER FOR USE WITH A CLOTHES WASHING MACHINE

(76) Inventors: Eugene J. Walsh, 223 Wildwood Rd., Ronkonkoma, NY (US) 11779; Patricia M. Walsh, 223 Wildwood Rd., Ronkonkoma, NY (US) 11779

( * ) Notice: Subject to any disclaimer, the term of this patent is extended or adjusted under 35 U.S.C. 154(b) by 17 days.

(21) Appl. No.: 09/905,840

(22) Filed: Jul. 16, 2001

(51) Int. Cl.[7] ..... D06F 39/00

(52) U.S. Cl. ..... 68/19.2; 68/20; 68/23 R; 68/134

(58) Field of Search ..... 68/19.2, 20, 23 R, 68/23.4, 134

(56) References Cited

U.S. PATENT DOCUMENTS

| | | | | |
|---|---|---|---|---|
| 3,702,069 | A | * | 11/1972 | Sharpe |
| 3,868,835 | A | * | 3/1975 | Todd-Reeve |
| 4,048,820 | A | | 9/1977 | Pielemeier |
| 4,152,844 | A | | 5/1979 | Materniak et al. |
| 4,977,690 | A | | 12/1990 | Davis, Jr. |
| 5,239,847 | A | | 8/1993 | Lee |
| 5,437,106 | A | | 8/1995 | Pardoe |
| 5,596,891 | A | * | 1/1997 | Bae et al. |
| 5,669,250 | A | * | 9/1997 | Dausch et al. |
| 5,878,600 | A | * | 3/1999 | Yeo et al. |
| 5,921,114 | A | * | 7/1999 | Jung |
| 5,931,029 | A | | 8/1999 | Kim |
| 6,006,445 | A | * | 12/1999 | Large |

FOREIGN PATENT DOCUMENTS

| | | | |
|---|---|---|---|
| DE | 883586 | * | 7/1949 |
| GB | 2047277 | * | 11/1980 |
| GB | 2107042 | * | 4/1983 |
| GB | 2264120 | * | 8/1993 |
| JP | 53-35271 | * | 4/1978 |
| JP | 1-317481 | * | 12/1989 |
| JP | 9-215887 | * | 8/1997 |
| JP | 10-43722 | * | 2/1998 |
| JP | 2000-27233 | * | 3/2000 |
| NL | 72915 | * | 7/1953 |

* cited by examiner

*Primary Examiner*—Frankie L. Stinson
(74) *Attorney, Agent, or Firm*—Donald R. Schoonover

(57) ABSTRACT

A clothes washing machine includes an accessory mounted on top of an agitator. The accessory includes fan blades that are stored in one configuration to be out of the way of articles being moved into or out of a washing tub of the washing machine and are deployed into an operational configuration by centrifugal force when the washing machine operates in a spin dry cycle. In the operational configuration, the fan blades are oriented to move air through ports defined in the door of the washing machine to and over articles being spun in the machine, and then out of other ports in the door. The air flow enhances the drying process occurring during the spin cycle.

11 Claims, 5 Drawing Sheets

AIR-CIRCULATION ENHANCER FOR USE WITH A CLOTHES WASHING MACHINE

BACKGROUND OF THE INVENTION

1. Field of the Invention

The present invention relates to the general art of textile fluid treating apparatuses, and to the particular field of machines for treating textiles with combined operations, and most particularly to clothes washing machines.

2. Discussion of the Related Art

In the field of textile treating apparatuses, there are numerous designs for clothes washing machines and accessories therefor. Clothes are generally placed into such washing machines, washed, then rinsed, and then spin dried. These machines generally have some sort of agitator to move the clothes in a desired manner to make the washing, rinsing and drying more efficient.

The spin dry cycle generally involves draining the wash tub of all water and then spinning the tub at a very high rate of speed with the agitator generally operating at a speed different from that of the tub. The spinning motion of the tub causes the clothes to move radially outward against the sides of the tub and then the centrifugal force squeezes the water out of the clothes.

This operation has worked well in the past. However, in recent times, the efficient use of energy has become more important. The inventor has discovered that the spin dry cycle of most presently available washing machines, while somewhat adequate, can be improved. This is especially evident when heavy clothes, such as jeans, or other heavy articles, such as towels, are washed. In many cases, these heavy articles are not dried as well as they could be during a spin dry cycle of a washing machine.

Because some articles are not dried as thoroughly as possible during the washing machine spin dry cycle, such articles may require extra time in a dryer, or even repeated dryer cycles to fully dry them. This may be wasteful of energy. Furthermore, some articles that are washed in a washing machine are left in the machine for some time. If the articles are too wet, mildew may begin to form, which is not desirable. Still further, wet articles may not be as clean smelling as many people would like.

Therefore, there is a need for a clothes washing machine that has a spin dry cycle that has efficiency improved over the efficiency of presently available washing machine spin dry cycles.

Many people who use washing machines have several tasks that they are performing simultaneously with the clothes washing/drying task. This situation creates a time management problem. These people do not want to waste time during the washing/drying task. In some instances, especially if the laundry load is heavy, the washing machine cycle is not completed in timed relationship to a dryer cycle. This requires the user to wait for the dryer to complete its cycle before emptying the washer into the dryer. This wastes time.

Therefore, there is a need for a washing machine that can dry the clothes in an efficient manner so that it is more likely to complete its cycle in a better timed relationship to a dryer cycle.

Still further, many people having washing machines do not wish to purchase a new washing machine to take advantage of the latest technology associated with washing machines. However, energy saving is such an important consideration, everyone who can take advantage of an energy-saving device will want to have such a device.

Therefore, there is a need for an accessory that can be retro-fit onto existing washing machines whereby such existing machines can take advantage of the savings associated with improved technology.

PRINCIPAL OBJECTS OF THE INVENTION

It is a main object of the present invention to provide a clothes washing machine that has a spin dry cycle that has efficiency improved over the efficiency of presently available washing machine spin dry cycles.

It is another object of the present invention to provide a washing machine that can complete its washing cycle in an efficient manner so that it is more likely to complete its cycle in a better timed relationship to a dryer cycle.

It is another object of the present invention to provide an accessory that can be retro-fit onto existing washing machines whereby such existing machines can take advantage of the savings associated with improved technology.

SUMMARY OF THE INVENTION

These, and other, objects are achieved by an accessory for use on a clothes washing machine that produces air flow over clothes undergoing a spin dry cycle in the washing machine. The air flow from the accessory is added to any air flow that normally occurs in such a spin dry cycle and increases the efficiency of the washing machine. The accessory includes fan blades that are stored out of the way so articles can be easily placed into the machine and removed from the machine, and automatically moves into a deployed configuration when the washing machine is in a spin dry cycle.

One form of the invention uses centrifugal force to deploy the accessory into its operational configuration. The accessory includes a fan with fan blades that are oriented to move air into the washing machine tub and over the articles in that tub during the spin dry cycle. Air ports can be included in the door of the washing machine to facilitate the flow of air created by the fan.

The increased air flow associated with the fan increases the drying efficiency of the washing machine spin cycle and thus decreases the time required to effect the spin dry cycle. This dries the articles more efficiently than is possible using presently known machines. Drier articles, such as clothes, from the washing machine reduces the time required for a dryer, and the number of dryer cycles required, to fully dry clothes. This is especially true for heavy loads, such as jeans and towels. The drier articles in the washing machine also reduces the possibility of mold forming on any articles that are left in the washing machine, and even makes the articles cleaner-smelling when they are removed from the washing machine.

The accessory can be sold with the machine as original equipment or easily added onto existing equipment thereby increasing the versatility of the accessory.

DETAILED DESCRIPTION OF THE INVENTION

Figure 1:
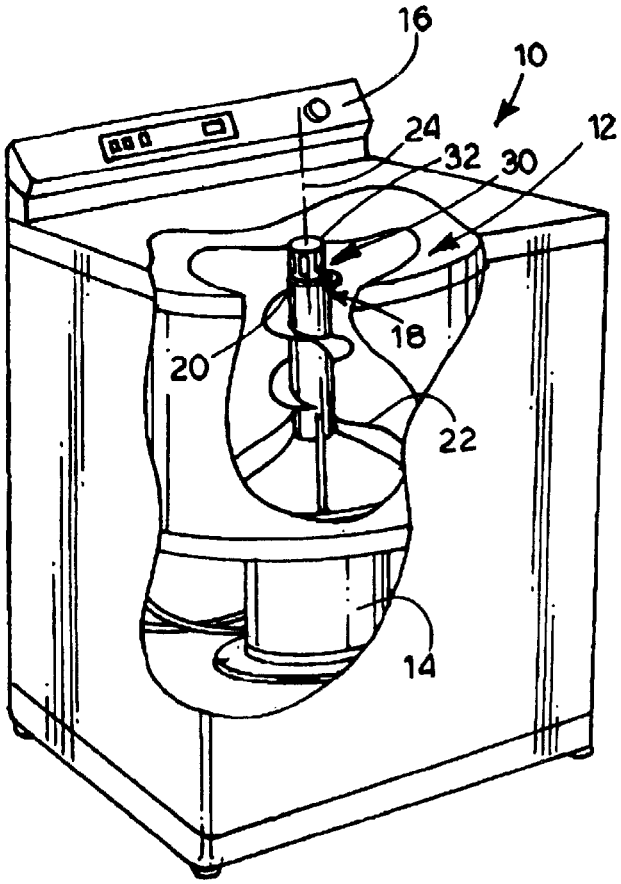
FIG. 1 is a perspective view of a washing machine having an accessory embodying the present invention installed thereon.

Other objects, features and advantages of the invention will become apparent from a consideration of the following detailed description and the accompanying drawings.

The accessory embodying the teaching of the present invention increases the efficiency of the drying cycle of a washing machine by increasing the air flow through the washing machine tub during the drying cycle. The accessory assumes a stored configuration when it is not in use so that it is out of the way when articles are inserted into or removed from the washing machine. However, the accessory automatically assumes a deployed operational configuration when the washing machine operates in a drying cycle.

As shown in FIGS. 1–12, the disclosed invention includes a clothes washing machine 10 comprising: a clothes washing tub 12 located inside the machine which is operated by a motor 14 and controlled by suitable switches located on a control panel 16 in the manner known in the art so that articles inserted into machine 10 via a door (not shown in FIG. 1) will be first subjected to a washing cycle, then a rinsing cycle, and then a drying cycle in accordance with the settings of the controls on control panel 16. Washing machine 10 further includes an agitator 18 located in clothes washing tub 12, with agitator 18 having a top end 20, a bottom end 22 and a longitudinal dimension 24 extending between the top end 20 of agitator 18 and bottom end 22 of agitator 18.

The foregoing portions of washing machine 10 are standard, and thus will not be further discussed. To increase the efficiency of the spin dry cycle, the present invention further includes an accessory 30 that can be included with washing machine 10 as an original factory-installed item when the washing machine is sold, or can be retro-fit onto an existing machine and, as such, will be sold in kit form.

Figure 2:
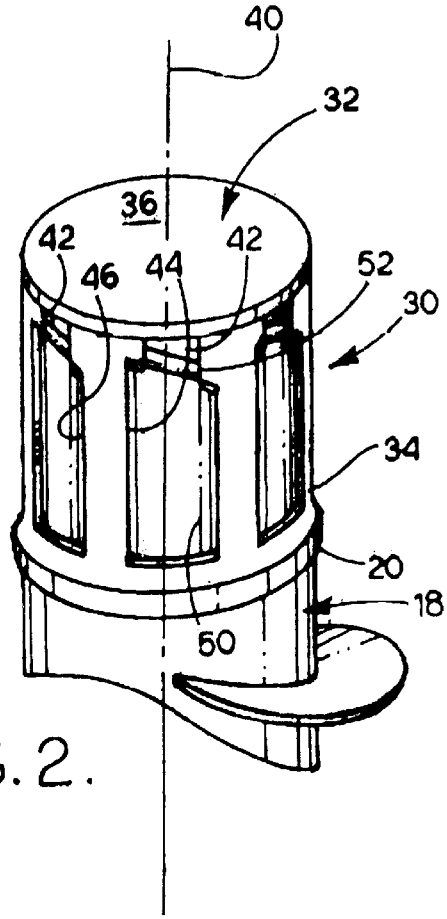
FIG. 2 is an enlarged perspective view of an accessory embodying the present invention installed on top of an agitator of a washing machine in accordance with the teaching of the present invention.

Accessory 30 comprises a body 32 which, in the use configuration, is mounted on top of agitator 18. Body 32 includes a bottom end 34 which, in use, is mounted on top of agitator 18 and a top end 36 spaced from bottom end 34 of body 32 along longitudinal dimension 24 of agitator 18 when body 32 is mounted on agitator 18 as shown in FIGS. 1 and 2. Accessory 30 further includes a longitudinal dimension 40 which extends between top end 36 of body 32 and bottom end 34 of body 32 and which, in the preferred form of the invention, is co-linear with longitudinal dimension 24 of agitator 18. Accessory 30 further includes a plurality of fan blade accommodating chambers, such as fan blade accommodating chamber 42, defined in body 32 to extend along the longitudinal dimension 40 of body 32. Each fan blade accommodating chamber 42 includes side walls 44 and 46 which extend along longitudinal dimension 40 and a rear wall 47.

Figure 4:
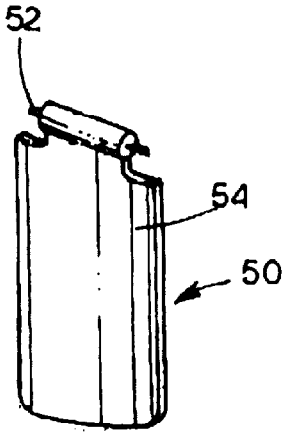
FIG. 4 is a perspective view of a fan blade that is used in the accessory of the present invention.

A plurality of fan blades, such as fan blade 50, are movably mounted on body 32. As shown in FIGS. 1, 2 and 4, each fan blade includes a pivot pin 52 mounted on two adjacent side walls 44 and 46 and spaced from rear wall 47 of each fan blade accommodating chamber 42. Pivot pin 52 is oriented to extend across the fan blade accommodating chamber at an oblique angle to the side walls of the fan blade accommodating chamber in which the pivot pin 52 is mounted to be oriented at an oblique angle with respect to the longitudinal dimension 24 of the agitator 18. In the preferred form of the accessory, this oblique angle is approximately 40°, but other angles could be used in accordance with the teaching of the present invention as will occur to those skilled in the art based on the teaching of the present disclosure. The purpose of the oblique angle will be understood from the following disclosure.

Figure 5:
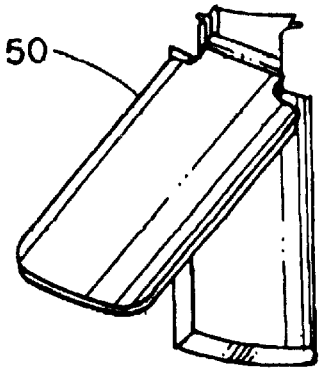
FIG. 5 shows a schematic view of a fan blade in a deployed configuration.
Figure 8:
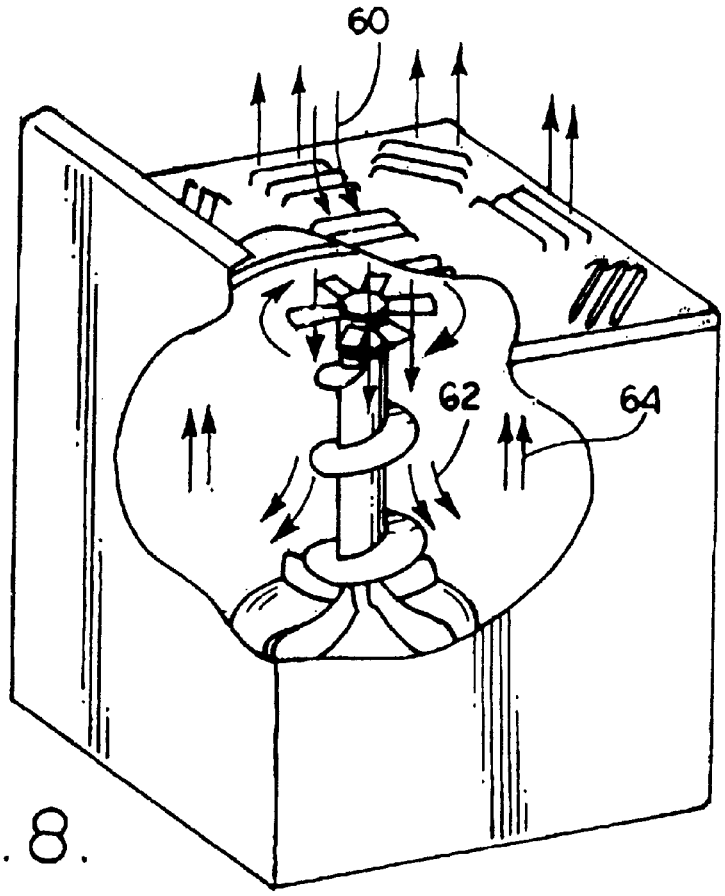
FIG. 8 shows the air flow pattern established by the accessory of the present invention.
Figure 9:
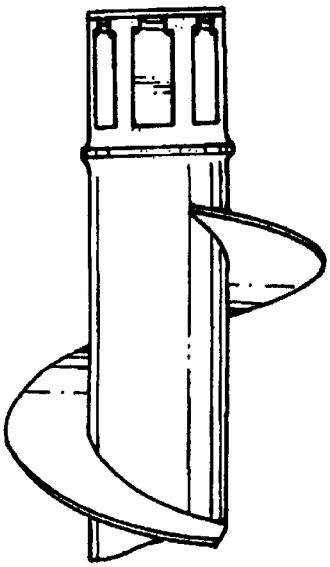
FIG. 9 shows an agitator of a washing machine with the fan blades of the accessory of the present invention in a stored configuration.
Figure 10:
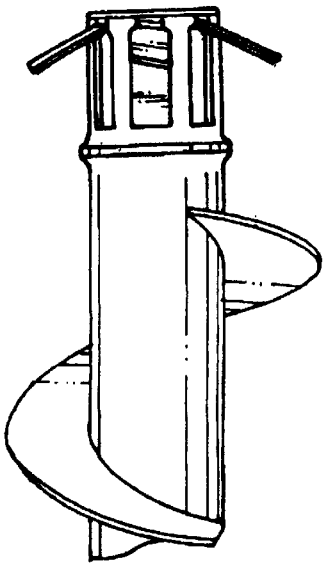
FIG. 10 shows an agitator of a washing machine with the fan blades of the accessory of the present invention in a deployed configuration.
Figure 11:
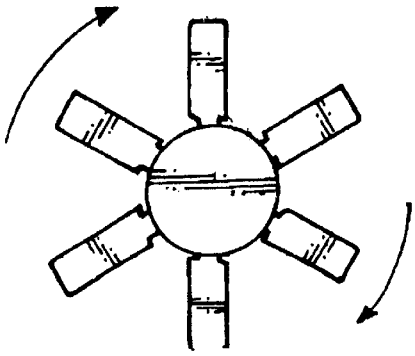
FIG. 11 is a top plan view of a fan of the accessory of the present invention in a deployed configuration.
Figure 12:
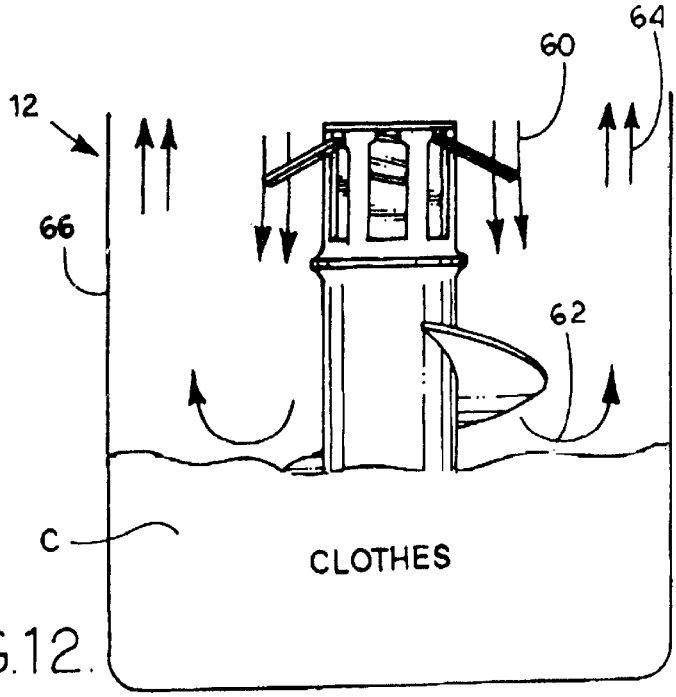
FIG. 12 shows the fan blades of the accessory of the present invention in a deployed configuration and the resulting air flow pattern established during a spin dry cycle of a washing machine that is equipped with the accessory.

Accessory 30 further includes a plurality of fan blade bodies, such as fan blade body 54, with each fan blade body 54 being pivotally connected to an associated pivot pin 52 to move between a rest configuration shown in FIG. 9 extending along the longitudinal dimension 40 of body 32 and a deployed configuration shown in FIGS. 8, 10, 11 and 12 extending outwardly from body 32. The oblique orientation of the pivot pins 52 cause the deployed fan blade bodies 54 to be oriented at a pitch angle with respect to body 32 as indicated in FIGS. 5, 10 and 12. In the deployed configuration of the fan blades, the fan blade bodies 54 extend outwardly from body 32 as shown in FIGS. 5, 8, 10, 11 and 12. In addition to the pitch angle of approximately 40°, the preferred form of the invention includes the fan blades extending outwardly from body 32 at an angle of approximately 90° with respect to the surface of body 32 immediately adjacent to the fan blade 50 whereby the fan blades 50 extend radially outwardly from body 32.

The pitched and outwardly extending fan blades 50 thus adopt a configuration that moves air to, through and past accessory 30 in the manner shown in FIGS. 8 and 12. This air movement includes a first downward direction 60, a second outward direction 62 over any articles, such as clothing C, located in tub 12 and a third upward direction 64 along outer wall 66 of tub 12. This air flow increases the efficiency of a drying process occurring during the spin dry cycle of washing machine 10.

As can be understood from the foregoing, the fan blades 50 assume an operational configuration as indicated in FIGS. 10 and 12 when agitator 18 begins to spin during the spin dry cycle. Centrifugal force causes the fan blades 50 to move from the stored configuration shown in FIG. 9 to the deployed configuration shown in FIGS. 10 and 12. In the stored configuration, the fan blades 50 are out of the way and articles can be placed into tub 12 and removed from tub 12 without contacting the fan blades 50.

Figure 6:
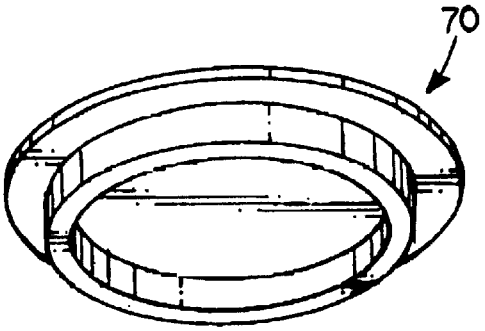
FIG. 6 shows a cap that can be used in connection with the accessory of the present invention.

A cap 70 is shown in FIG. 6 and is removably mounted on top end 36 of body 32 when the fan blade bodies 54 are in the rest configuration to ensure that the fan blade bodies 54 remain in the rest position.

Figure 3:
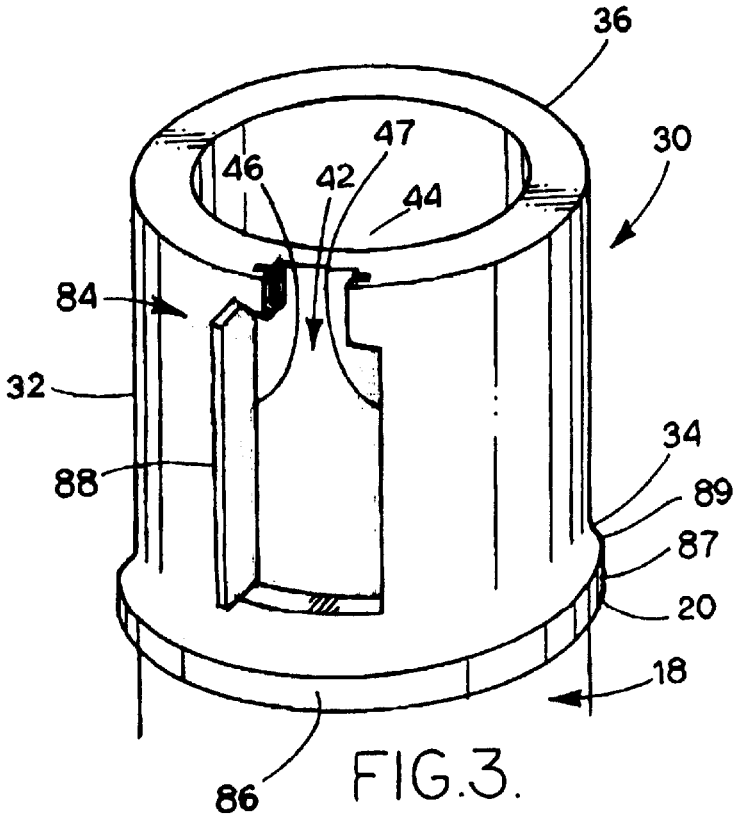
FIG. 3 is an enlarged view of an accessory of the present invention showing a groove in which a fan blade is accommodated.

To further ensure that the fan blade bodies 54 do not interfere with article movement into and out of tub 12, accessory 30 further includes a guard 84 on body 32 adjacent to and associated with each fan blade accommodating chamber 42. Each guard 84 extends outwardly from body 32 and each guard 84 includes a bottom portion 86 located near bottom end 34 of body 32 and a side portion 88 extending from bottom portion 86 of each guard 84 toward top end 36 of body 32 adjacent to side wall 46 of fan blade accommodating chamber 42 in which the associated fan blade 50 is located. The bottom portion 86 of the guard 84 can be a ledge defined by an offset orientation between body 32 and outer rim 87 of agitator 18. This offset orientation is indicated in FIG. 3 as ledge 89. In such a case, the ledge extends generally completely around body 32.

Figure 7:
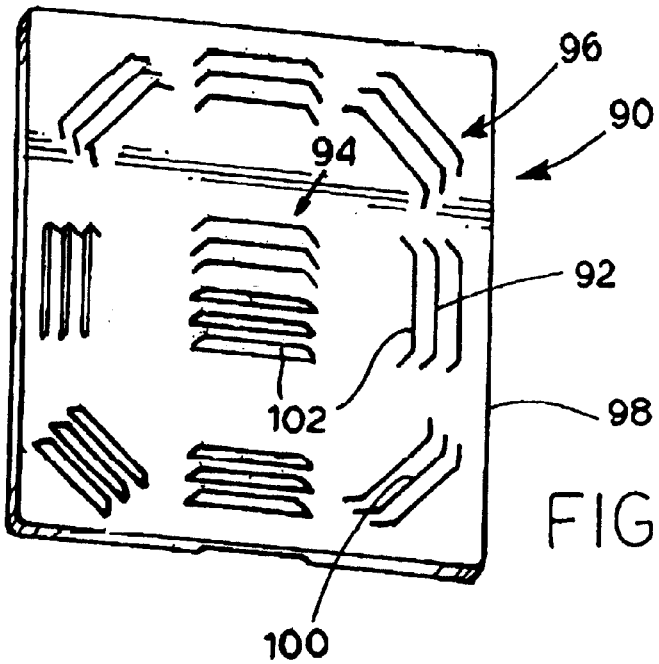
FIG. 7 shows a cover door for a washer that is equipped with the accessory of the present invention.

As discussed above, air moves into, through and out of the washing machine tub 12 during the drying cycle under the influence of accessory 30. In order to facilitate this air movement, washing machine 10 includes a cover door 90 on the clothes washing machine. The door is best shown in FIG. 7 and includes a plurality of air flow ports, such as air flow port 92, defined therethrough. As can be seen in FIG. 7, plurality of air flow ports 92 includes a first group 94 of air flow ports located to be adjacent to body 32 when cover door 90 is closed and body 32 is mounted on agitator 18. The plurality of air flow ports further includes a second group 96 of air flow ports located near outer perimeter 98 of cover door 90. As can be seen in FIG. 7, first group 94 of air flow ports is centrally located on cover door 90 and the second group of air flow ports further includes a plurality of sub-groups 100 of air flow ports with sub-groups 100 of air flow ports being generally evenly arcuately spaced apart from each other. In the preferred form of door 90, sub-groups 100 are spaced apart from each other by arc lengths equal to approximately 45° whereby there are eight sub-groups of air ports. However, any number and/or spacing associated with the sub-groups and/or the central group of air ports can be used as will be understood by one skilled in the art based on the teaching of this disclosure without departing from the scope of this disclosure.

A louver, such as louver 102, is located on the door adjacent to each air flow port to direct air in the desired direction as indicated in FIGS. 8 and 12.

Figure 15:
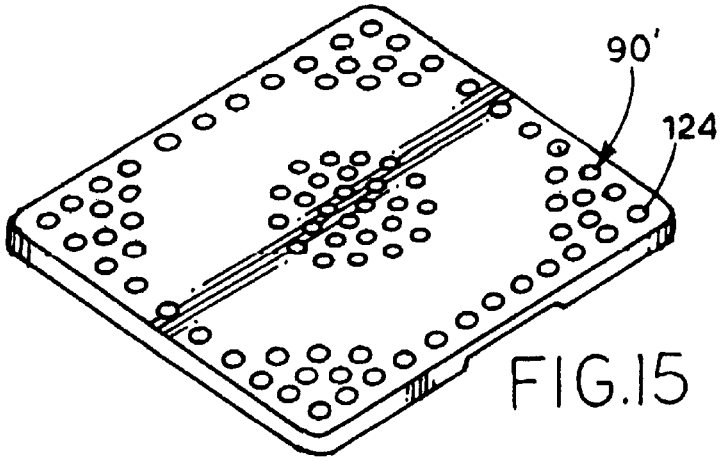
FIG. 15 shows another form of a washing machine door used in connection with the accessory of the present invention.
Figure 13:
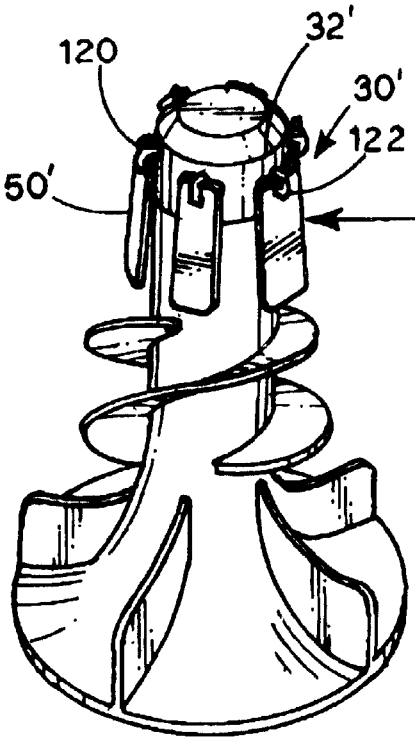
FIG. 13 is another form of the accessory on an agitator in accordance with the teaching of the present invention.
Figure 14:
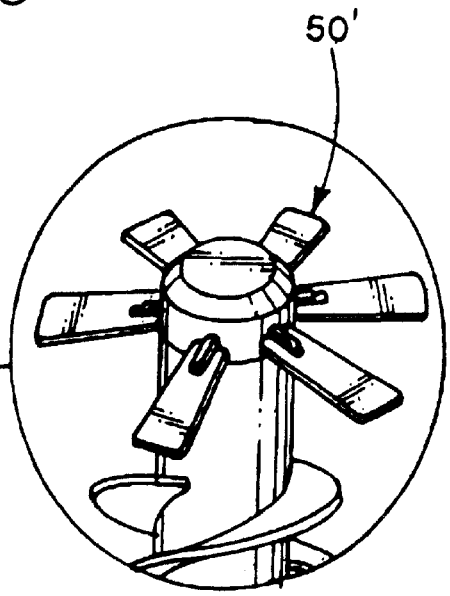
FIG. 14 is an enlarged view of the accessory of the present invention with the fan blades thereof in a deployed configuration.
Figure 14A:
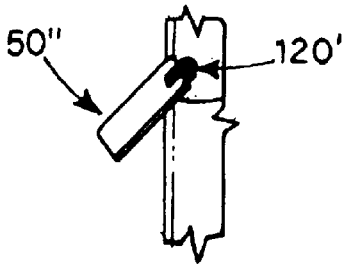
FIG. 14A shows a connection between a fan blade and an agitator that is alternative to the connection shown in FIG. 14.

An alternative form of the accessory is shown in FIGS. 13–15. Accessory 30' is similar to accessory 30, except that fan blades 50' are hingeably attached to body 32' by rings, such as ring 120 fitting through a ring opening, such as opening 122 on the fan blade 50'. Fan blades 50' do not automatically assume a pitch angle when in the deployed configuration shown in FIG. 14, but the rings 120' can be canted to effect such a pitched orientation of a fan blade 50" if desired. A pitched orientation of a fan blade 50" is shown in FIG. 14A to indicate this circumstance.

A further alternative for the accessory is shown in FIG. 15 with a cover door 90' where circular openings 124 have replaced the elongated air ports 92 shown in FIG. 7. Of course, doors 90 and 90' are interchangeable and each can be used with accessory 30 or accessory 30' or with fan blades 50" as will be understood by those skilled in the art based on the teaching of the present disclosure.

It is understood that while certain forms of the present invention have been illustrated and described herein, it is not to be limited to the specific forms or arrangements of parts described and shown.

We claim:

1. An accessory for a clothes washing machine comprising:

a) a body which, in use, is mounted on top of an agitator mechanism of a clothes washing machine, said body including
   (1) a bottom end which, in use, is mounted on top of the agitator mechanism of the clothes washing machine,
   (2) a top end spaced from the bottom end of said body along a longitudinal dimension of the agitator when said body is mounted on the agitator mechanism,
   (3) a longitudinal dimension of said body extending between said top end of said body and said bottom end of said body, and
   (4) a plurality of fan blade accommodating chambers defined in said body to extend along said longitudinal dimension of said body, each fan blade accommodating chamber including side walls;

b) a plurality of fan blades movably mounted on said body, each fan blade including
   (1) a pivot pin mounted on two adjacent side walls of each fan blade accommodating chamber, said pivot pin being oriented to extend across the fan blade accommodating chamber at an oblique angle to said side walls of the fan blade accommodating chamber in which said pivot pin is mounted to be oriented at an oblique angle with respect to said longitudinal dimension of the agitator mechanism,
   (2) a plurality of fan blade bodies, with each fan blade body pivotally connected to an associated pivot pin to move between a rest configuration extending along said longitudinal dimension of said body and a deployed configuration extending outwardly from said body, said fan blade bodies being oriented at a pitch angle with respect to said body and extending outwardly from the body when said accessory is in said deployed configuration;

c) a cap removably mounted on the top end of said body when said fan blade bodies are in the rest configuration;

d) a guard on said body adjacent to and associated with each said fan blade accommodating chamber and extending outwardly from said body, each guard including a bottom portion located near the bottom end of said body and a side portion extending from the bottom end of each guard toward the top end of said body adjacent to a side wall of respective said fan blade accommodating chamber in which said associated fan blade is located.

2. The accessory defined in claim 1 wherein the pitch angle is approximately 40°.

3. The accessory defined in claim 2 wherein each fan blade extends radially outwardly from said body at an angle of approximately 90° with respect to the longitudinal dimension of the agitator mechanism of the clothes washing machine.

4. The accessory defined in claim 1 further including a cover door on the clothes washing machine, said cover door including a plurality of air flow ports defined therethrough.

5. The accessory defined in claim 4 wherein said plurality of air flow ports includes a first group of air flow ports located to be adjacent to said body when said cover door is closed and said body is mounted on the agitator of the washing machine.

6. The accessory defined in claim 5 wherein said plurality of air flow ports further includes a second group of air flow ports located near an outer perimeter of said cover door.

7. The accessory defined in claim 6 wherein said first group of air flow ports is centrally located on said cover door and said second group of air flow ports includes a plurality of sub-groups of air flow ports with said sub-groups of air flow ports being evenly arcuately spaced apart from each other.

8. The accessory defined in claim 7 wherein the spacing between adjacent sub-groups of air flow ports is approximately 45°.

9. The accessory defined in claim 8 further including a louver adjacent to each air flow port.

10. An accessory for a clothes washing machine comprising:

a) a body which, in use, is mounted on top of an agitator mechanism of a clothes washing machine, said body including
   (1) a bottom end which, in use, is mounted on top of the agitator mechanism of the clothes washing machine,
   (2) a top end spaced from said bottom end of said body along a longitudinal dimension of the agitator mechanism when said body is mounted on the agitator mechanism wherein said longitudinal dimension of said body extends between said top end of said body and said bottom end of said body, and
   (3) a plurality of fan blade accommodating chambers defined in said body to extend along said longitudinal dimension of said body, each fan blade accommodating chamber including side walls;

b) a plurality of fan blades movably mounted on said body, each fan blade including
   (1) a pivot pin mounted on two adjacent side walls of each fan blade accommodating chamber, said pivot pin being oriented to extend across said fan blade accommodating chamber in which said pivot pin is mounted,
   (2) a plurality of fan blade bodies, with each fan blade body pivotally connected to an associated pivot pin to move between a rest configuration extending along the longitudinal dimension of said body and a deployed configuration extending outwardly from said body;

c) a cap removably mounted on said top end of said body when said fan blade bodies are in the rest configuration;

d) a guard on said body adjacent to and associated with each fan blade accommodating chamber and extending outwardly from said body, each guard including a bottom portion located near the bottom end of said body and a side portion extending from the bottom end of each guard toward the top end of said body adjacent to a side wall of the fan blade accommodating chamber in which the associated fan blade is located.

11. A clothes washing machine comprising:

a) a clothes washing tub;

b) an agitator located in said clothes washing tub and having a top end and a bottom end and a longitudinal dimension extending between the top end of said agitator and the bottom end of said agitator;

c) an accessory which comprises
   (1) a body which, in use, is mounted on top of said agitator mechanism of the clothes washing machine, said body including
      (A) a bottom end which, in use, is mounted on top of the agitator of the clothes washing machine,
      (B) a top end spaced from the bottom end of said body along the longitudinal direction of the agitator when said body is mounted on the agitator,
      (C) a longitudinal dimension of said body extending between the top end of said body and the bottom end of said body, and
      (D) a plurality of fan blade accommodating chambers defined in said body to extend along the longitudinal dimension of said body, each fan blade accommodating chamber including side walls;
   (2) a plurality of fan blades movably mounted on said body, each fan blade including
      (a) a pivot pin mounted on two adjacent side walls of each fan blade accommodating chamber, said pivot pin being oriented to extend across the fan blade accommodating chamber at an oblique angle to the side wall of the fan blade accommodating chamber in which the pivot pin is mounted to be oriented at an oblique angle with respect to the longitudinal direction of the agitator,
      (b) a plurality of fan blade bodies, with each fan blade body pivotally connected to an associated pivot pin to move between a rest configuration extending along the longitudinal dimension of said body and a deployed configuration extending outwardly from said body, said fan blade bodies being oriented at a pitch angle with respect to said body and extending outwardly from the body when the accessory is in said deployed configuration;
   (3) a cap removably mounted on the top end of said body when said fan blade bodies are in the rest configuration;
   (4) a guard on said body adjacent to and associated with each fan blade accommodating chamber and extending outwardly from said body, each guard including a bottom portion located near the bottom end of said body and a side portion extending from the bottom end of each guard toward the top end of said body adjacent to a side wall of the fan blade accommodating chamber in which the associated fan blade is located.

* * * * *